US011203884B2

(12) United States Patent
Marsden

(10) Patent No.: US 11,203,884 B2
(45) Date of Patent: Dec. 21, 2021

(54) DOOR HANDLE LOCK

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 368 days.

(21) Appl. No.: 15/705,211

(22) Filed: Sep. 14, 2017

(65) Prior Publication Data

US 2019/0078351 A1 Mar. 14, 2019

(51) Int. Cl.
*E05B 13/00* (2006.01)
*E05B 65/00* (2006.01)
(Continued)

(52) U.S. Cl.
CPC ..... *E05B 13/00* (2013.01); *E05B 13/002* (2013.01); *E05B 13/001* (2013.01); *E05B 13/007* (2013.01);
(Continued)

(58) Field of Classification Search
CPC ..... E05B 13/00; E05B 13/001; E05B 13/002; E05B 13/007; E05B 13/04; E05B 65/0014; E05B 17/2007; Y10T 70/915; Y10T 70/5774; Y10T 292/34; Y10T 292/1028; Y10T 292/397; Y10T 292/1089; Y10T 292/228; Y10T 292/0908; Y10T 292/37; Y10T 292/57; Y10T 70/411; Y10T 70/8649; Y10T 70/7915; Y10T 292/03; E05C 19/181
See application file for complete search history.

(56) References Cited

U.S. PATENT DOCUMENTS 366,150 A 7/1887 Busfield
372,326 A * 11/1887 Palmenberg ..... E05C 17/166 292/268
(Continued)

FOREIGN PATENT DOCUMENTS

AU 520347 B2 1/1982
CH 90452 A 9/1921
(Continued)

OTHER PUBLICATIONS

U.S. Appl. No. 29/617,592, filed Sep. 14, 2017, Marsden.
(Continued)

*Primary Examiner* — Christine M Mills
*Assistant Examiner* — Faria F Ahmad
(74) *Attorney, Agent, or Firm* — Wolf, Greenfield & Sacks, P.C.

(57) ABSTRACT

Methods and apparatus for using a look on a door lever handle are disclosed. The lock includes a base configured to mount the lock to a door having a lever handle and a lever handle guard pivotally attached to the base, the lever handle guard being pivotable between a locking position and a non-locking position. The lever handle guard is securable in the non-locking position. The lever handle guard includes first and second guard portions arranged to prevent rotation of the lever handle when the lever handle guard is in the locking position. When the lever handle guard is secured in the non-locking position, the first and second guard portions are arranged to permit rotation of the lever handle without contacting the first and second guard portions.

36 Claims, 11 Drawing Sheets

(51) Int. Cl.
*E05B 13/04* (2006.01)
*E05C 19/18* (2006.01)
*E05B 17/20* (2006.01)

(52) U.S. Cl.
CPC ..... *E05B 13/04* (2013.01); *E05B 17/2007* (2013.01); *E05B 65/0014* (2013.01); *E05C 19/18* (2013.01); *Y10T 292/03* (2015.04); *Y10T 292/0908* (2015.04); *Y10T 292/1028* (2015.04); *Y10T 292/1089* (2015.04); *Y10T 292/228* (2015.04); *Y10T 292/34* (2015.04); *Y10T 292/37* (2015.04); *Y10T 292/397* (2015.04); *Y10T 292/57* (2015.04)

(56) References Cited

U.S. PATENT DOCUMENTS 1,239,802 A * 9/1917 MacBeth ..... E05C 19/18 292/258
2,151,587 A * 3/1939 Cassileth ..... E05C 19/18 292/288
2,331,150 A 12/1941 Whiting, Jr.
2,463,195 A 3/1949 Mungan
3,423,974 A * 1/1969 Bernsley ..... E05B 13/002 70/416
3,643,478 A * 2/1972 McPeake ..... E05B 13/002 70/212
3,791,096 A * 2/1974 Epperlein ..... E04B 2/7457 403/315
3,933,014 A * 1/1976 Moses ..... E05B 13/04 70/416
4,062,578 A * 12/1977 Chen ..... E05C 17/166 292/262
4,226,453 A * 10/1980 Robertson ..... E05C 17/166 292/268
4,229,030 A * 10/1980 Tarragona Corbella ..... E05C 17/166 292/270
4,279,137 A * 7/1981 Cook ..... E05B 13/04 70/416
4,334,705 A * 6/1982 Rumph ..... E05C 19/18 292/288
4,408,789 A * 10/1983 Miller ..... E05C 17/166 292/268
4,575,140 A * 3/1986 Dargis ..... E05C 19/184 292/288
4,947,663 A * 8/1990 Yeager ..... E05B 13/002 70/416
4,955,648 A * 9/1990 Miller ..... E05C 19/18 292/258
5,000,498 A * 3/1991 Upchurch ..... E05B 13/04 292/256.67
5,052,202 A * 10/1991 Murphy ..... E05B 13/04 70/211
D334,703 S * 4/1993 Murphy ..... D8/331
5,313,812 A * 5/1994 Eklund ..... E05B 13/04 70/416
5,651,279 A * 7/1997 Berton ..... E05B 13/001 292/359
5,689,984 A * 11/1997 Diculescu ..... E05B 13/002 70/214
5,950,465 A 9/1999 Schultz et al.
6,301,941 B1 * 10/2001 Nicholsfigueiredo .. E05B 13/04 292/150
6,416,089 B1 * 7/2002 Williams, Jr. ..... E05C 19/182 292/288
6,658,906 B1 * 12/2003 Wright ..... E05B 13/001 292/292
6,929,292 B1 8/2005 Galindo et al.
7,048,315 B2 5/2006 Wong
7,175,213 B1 * 2/2007 Blangiardo ..... E05B 13/002 292/1
7,216,903 B1 * 5/2007 Kent ..... E05B 13/002 292/288
7,278,284 B1 * 10/2007 James ..... E05B 13/002 292/205
7,416,230 B2 * 8/2008 Konstantakis ..... E05B 13/002 292/1
D618,083 S * 6/2010 Hansen ..... D8/346
7,971,459 B2 7/2011 Price
8,177,268 B2 5/2012 Varney et al.
8,312,748 B2 * 11/2012 Bundy ..... E05B 13/00 70/416
8,443,640 B2 * 5/2013 Davis ..... E05B 13/04 70/416
8,596,100 B1 * 12/2013 Crispell ..... E05B 19/0005 70/63
8,756,965 B1 * 6/2014 Anderson ..... E05B 13/001 70/455
9,309,702 B2 * 4/2016 Hwang ..... E05C 17/166
9,373,459 B1 * 6/2016 Mininberg ..... E05B 13/002
9,976,325 B2 * 5/2018 Zolman ..... E05C 17/54
10,181,233 B1 * 1/2019 Haber ..... E05B 39/04
10,221,587 B1 * 3/2019 Bergman ..... E05B 13/002
10,392,841 B2 * 8/2019 Kopp, Sr. ..... E05C 17/36
2002/0067046 A1 * 6/2002 Cox, Sr. ..... E05C 19/184 292/289
2004/0140676 A1 * 7/2004 Eklund ..... E05B 65/0021 292/97
2004/0183315 A1 * 9/2004 O'Donohoe ..... E05B 13/002 292/288
2004/0256862 A1 * 12/2004 Wong ..... E05B 13/002 292/165
2005/0193787 A1 * 9/2005 Davis ..... E05B 13/04 70/416
2006/0170226 A1 * 8/2006 Konstantakis ..... E05B 65/0014 292/336.3
2006/0272365 A1 * 12/2006 Copus ..... E05B 13/002 70/14
2007/0007778 A1 * 1/2007 Gomes ..... E05B 1/0053 292/336.3
2007/0170730 A1 7/2007 Hall
2008/0018463 A1 * 1/2008 Morrow ..... G08B 21/18 340/542
2008/0042451 A1 * 2/2008 Moore ..... E05C 19/18 292/288
2009/0302617 A1 * 12/2009 Schmid ..... E05B 65/10 292/92
2009/0322106 A1 * 12/2009 Wood ..... E05C 7/00 292/288
2010/0031715 A1 * 2/2010 Bundy ..... E05B 13/00 70/129
2010/0102573 A1 * 4/2010 Rancatore ..... E05B 13/00 292/93
2010/0122559 A1 * 5/2010 Chudzicki ..... E05B 13/002 70/56
2010/0199727 A1 * 8/2010 Varney ..... E05B 13/00 70/209
2012/0222459 A1 * 9/2012 Glazar ..... E05B 13/04 70/91
2012/0235427 A1 * 9/2012 Miskel ..... E05C 19/186 292/288
2013/0269401 A1 * 10/2013 Allen, Sr. ..... E05B 13/04 70/107
2014/0007632 A1 * 1/2014 Daniels ..... E05B 13/04 70/447
2014/0175814 A1 6/2014 Holsopple
2014/0245798 A1 * 9/2014 Beckman ..... E05B 13/002 70/14
2015/0130197 A1 * 5/2015 Eller ..... E05B 65/0032 292/336.3
2018/0209171 A1 * 7/2018 Morrison ..... E05C 19/18
2019/0153746 A1 5/2019 Wang

FOREIGN PATENT DOCUMENTS

DE 127762 C 4/1901
DE 29503660 U1 4/1995

(56) References Cited

FOREIGN PATENT DOCUMENTS

| | | | |
|---|---|---|---|
| GB | 249032 | A | 3/1926 |
| GB | 2 088 463 | A | 6/1982 |
| GB | 2 352 472 | A | 1/2001 |
| GB | 2 406 137 | B | 11/2005 |
| GB | 2 536 855 | A | 10/2016 |
| JP | 2006-022544 | A | 1/2006 |
| JP | 2012-167447 | A | 9/2012 |
| JP | 2012-188883 | A | 10/2012 |
| JP | 2012-219562 | A | 11/2012 |
| JP | 5636305 | B2 | 12/2014 |
| KR | 20-2010-003972 | U | 4/2010 |

OTHER PUBLICATIONS

PCT/IB2018/001159, Feb. 1, 2019, International Search Report and Written Opinion.

[No. Author Listed] Lever Handle Lock. Summer Infant Baby Products. https://www.summerinfant.com/child-proofing/lever-handle-lock, 2 pages [last accessed Aug. 31, 2017].

International Search Report and Written Opinion for International Application No. PCT/IB2018/001159, dated Feb. 1, 2019.

* cited by examiner

DOOR HANDLE LOCK

FIELD

The disclosed embodiments are generally directed to lever handle locking systems and more particularly to locking systems for door lever handles.

DISCUSSION OF THE RELATED ART

Locking systems and door knob covers are known for helping prevent a door from being opened. For example, a locking system for a door lever handle may be installed on a door to prevent a young child from being able to turn the handle and open the door.

SUMMARY

According to one embodiment, a lock for a door lever handle is disclosed. The lock includes a base configured to mount the lock to a door having a lever handle, and a lever handle guard pivotally attached to the base, the lever handle guard being pivotable between a locking position and a non-locking position. The lever handle guard is securable in the non-locking position. The lever handle guard includes a first guard portion arranged to prevent rotation of the lever handle beyond a first rotation angle in a first direction when the lever handle guard is in the locking position, and a second guard portion arranged to prevent rotation of the lever handle beyond a second rotation angle in a second direction when the lever handle guard is in the locking position, the second direction being opposite to the first direction. When the lever handle guard is secured in the non-locking position, the first and second guard portions are arranged to permit rotation of the lever handle in the first and second rotation directions beyond the first and second rotation angles without contacting the first and second guard portions.

According to another embodiment, a method of using a lever door handle lock on a door that has a lever handle is disclosed. The lever door handle lock includes a base and a lever handle guard pivotally attached to the base, the lever handle guard being pivotable between a locking position and a non-locking position, wherein, in the locking position, the lever handle guard prevents rotation of the lever handle beyond a first rotation angle in a first direction and prevents rotation of the lever handle beyond a second rotation angle in a second direction. The method includes pivoting the lever handle guard from the locking position to the non-locking position, and securing the lever handle guard in the non-locking position to permit rotation of the lever handle.

According to another embodiment, a lock for a door lever handle includes a base configured to mount the lock to a door having a lever handle, and a lever handle guard pivotally attached to the base, the lever handle guard being pivotable between a locking position and a non-locking position and being rotatable about a vertical pivot axis. The lever handle guard is securable in a non-locking position to permit rotation of the lever handle.

According to another embodiment, a lock for a door lever handle includes a base configured to be mounted to a door, and a lever handle guard attached to the base, the lever handle guard being movable between a locking position and a non-locking position. The lever handle guard includes a first guard portion arranged to prevent rotation of the lever handle beyond a first rotation angle in a first direction when the lever handle guard is in the locking position, and a second guard portion arranged to prevent rotation of the lever handle beyond a second rotation angle in a second direction when the lever handle guard is in the locking position, the second direction being opposite to the first direction. The lever handle guard is securable in the locking position. The first guard portion is moveable closer to the second guard portion to unsecure the lever handle guard from the locking position.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
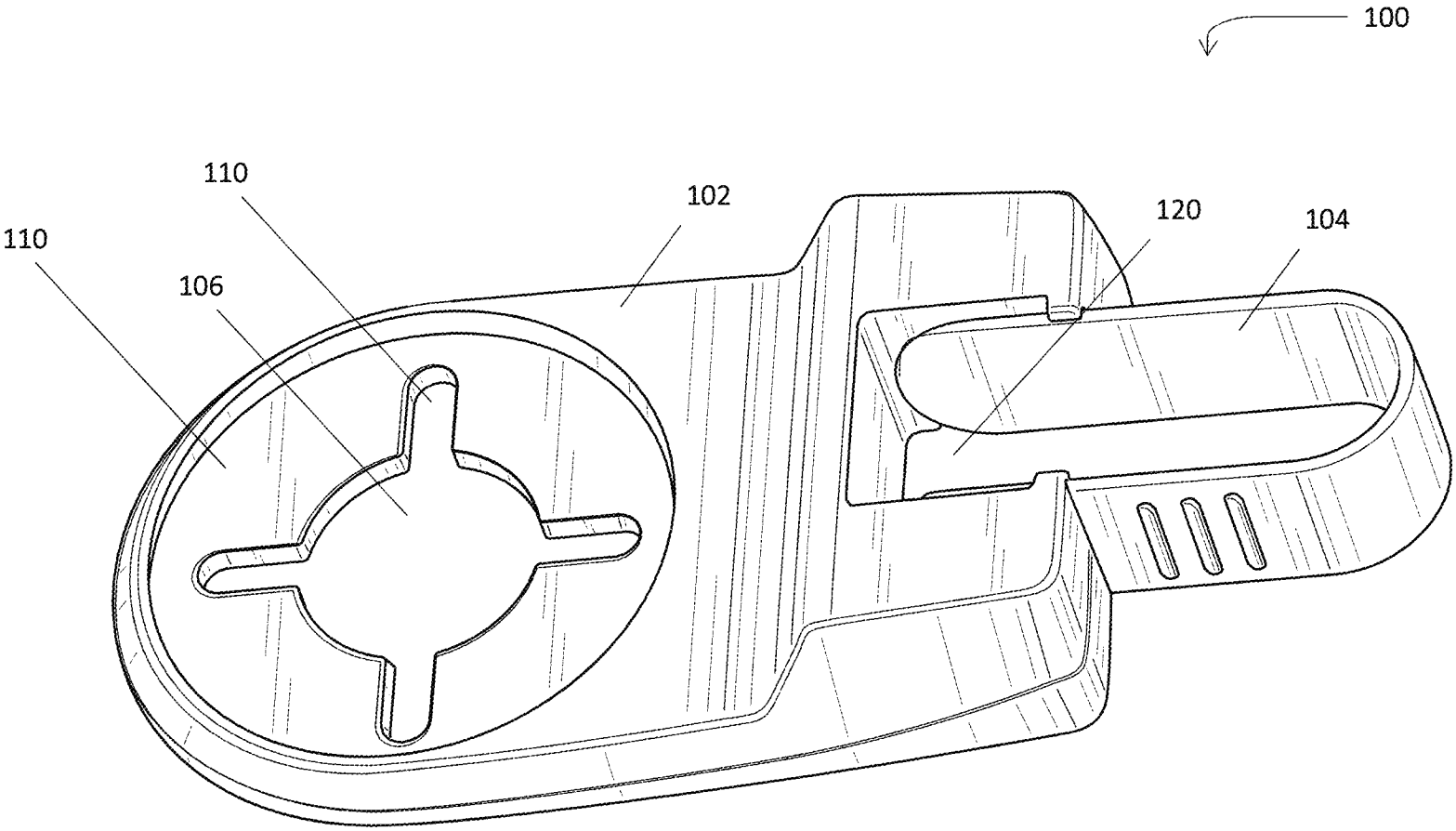
FIG. 1 is a top perspective view of a lever handle lock according to embodiments of the present disclosure.

Lever door handles that retract door latches are a common arrangement in many homes and offices. Typically, when the lever handle is rotated either upwardly or downwardly, the handle rotates a spindle which pulls back the door latch to release the door's engagement with the doorframe. The spindle may actuate a cam drive unit and pull back a transmission plate within the latch assembly to pull back the latch.

Some door latches may include locking arrangements, such that a user may lock the door to one or more areas of their home. In such examples, to open the door, the user must both unlock the latch and rotate the lever handle. In other embodiments, the door latch may not have a lock. In such embodiments, to open the door, the user may simply rotate the lever and open the door.

For doors in which there are no locking arrangements on the door latch, the user may wish to prevent a door from being opened. For example, the user may wish to prevent young children from being able to rotate a lever handle and open the door. For doors that have key locks, it may be desirable to provide a way to block rotation of the handle without having to use the key lock.

Applicant has recognized that advantages may be realized if the lever handle lock has securable locking and non-locking positions between which the lever handle lock may be moved. In such embodiments, by securing the lever handle lock in the non-locking position, the user is prevented from inadvertently locking himself out of a room by having the handle lock move itself back into a blocking position. Applicant has further recognized that a resiliently deformable lever door handle guard can provide a convenient and effective way to discourage young children from rotating a lever door handle.

According to embodiments of the present disclosure, a lever handle lock includes a base and a handle guard attached to the base. The base is configured to mount the lever handle lock to the door. For example, the lever handle may be removed, and the base may be placed on the door and include an aperture through which the handle is passed when the handle is reattached. In such an example, the base may be mounted to the door via a door knob rose and/or a mounting plate. In some embodiments, the base may be sandwiched between the rose and the door while mounting the lever handle to the door. In other embodiments, the base may be fixedly attached to the door, separate from the door handle. In such embodiments, fasteners such as screws, bolts, nails or other fasteners may be used. For example, the base may include one or more channels or holes through which one or more fasteners may be passed. Additional fasteners may not be needed to attached the lock to the door. For example, the handle guard lock may be mounted to the door by simply sandwiching the base in between the rose and the door, with the door handle being attached with its typical fasteners. In some embodiments, the base includes a baseplate.

In some embodiments, the handle guard is pivotably attached to the base and is pivotable relative to the base between a locking position and a non-locking position. In some embodiments, the handle guard is pivotable about a pivot axis. In some embodiments, the pivot axis is vertical when the lever handle lock is mounted to the door.

In some embodiments, in the locking position, the handle guard is positioned around at least a portion of the lever handle to prevent the lever handle from rotating enough to pull back the latch and release the door from the doorframe. For example, if a child tries to move the lever handle upwardly or downwardly, the lever handle would contact the handle guard and be unable to rotate further to open the door. As will be appreciated, when the handle guard is in the locking position, the lever handle may still be able to rotate slightly.

In the non-locking position, the lever handle guard is moved away from the lever handle such that the lever handle is permitted to rotate. For example, in the non-locking position, the lever handle can function as it would normally to open the door. In some embodiments, when the lever handle guard is in the non-locking position, the lever may rotate without contacting the lever handle guard. Such an arrangement may provide an easier motion to opening the door as compared to lever handle locks where the handle contacts a portion of the lock even when the lock does not prevent movement of the lever handle.

In some embodiments, in the locking position, the handle guard may be positioned substantially perpendicular to the base and to the lever handle. In the non-locking position, the handle guard may be positioned substantially parallel to the base and to the lever handle.

In some embodiments, the handle guard includes an elongated loop, with each end of the loop being attached to the base. In the locking position, at least a portion of the lever handle may extend into and/or through the loop. In the non-locking position, the lever handle may be unobstructed by the loop. As will be appreciated, the handle guard may have other suitable shapes. For example, the handle guard may include a rectangular protrusion with a hole sized to surround the lever handle. In some embodiments, the lever handle guard has two separate bars that each can individually block one side of the lever handle.

In some embodiments, the handle guard is arranged to be secured in the each of the locking and non-locking positions. For purposes herein, being secured in one of the locking and non-locking positions means that the handle guard is maintained in the relevant position until the user performs an action to unsecure the handle guard such that the handle guard can be moved to the other position. In such embodiments, the unsecuring action performed by the user is an action that is distinct from the user action that moves the handle guard from one position to the other. For example, as described below, in some embodiments the handle guard has two portions which are squeezed toward each other to unsecure the handle lock and allow the handle lock to pivot.

In some embodiments, the base includes a recess in which at least a portion of the handle guard is received. In such embodiments, the recess may have blockers to obstruct movement of the handle guard once the handle guard is secured in one of the locking and non-locking positions. In some embodiments, the recess includes one or more protrusions that extend into the recess to trap the handle guard within the recess. In such embodiments, to rotate the handle guard between the locking and unlocking positions, the user deforms at least a portion of the handle to move the handle between.

Figure 2:
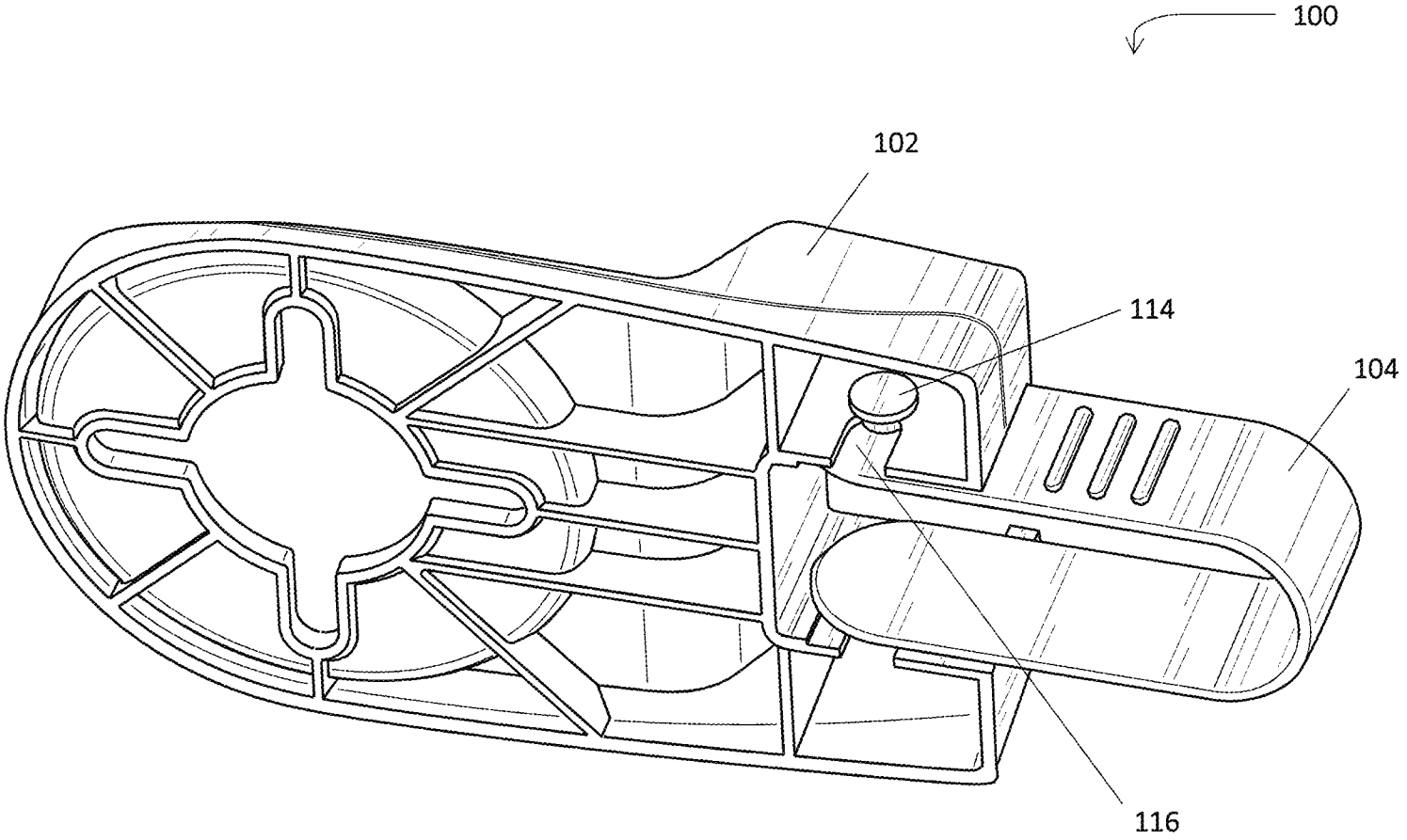
FIG. 2 is a bottom perspective view of the lever handle lock of FIG. 1.

Turning now to the figures, FIGS. 1 and 2 show a lever handle lock 100 according to embodiments of the present disclosure. As shown in FIG. 1, the lock 100 includes a base 102 and a lever handle guard 104 attached to the base. In some embodiments, the base 102 may include a baseplate, although the base may include other suitable arrangements. In some embodiments, the handle guard 104 includes a loop, with each end of the loop being attached to the base. As will be appreciated, the handle guard may have other arrangements in other embodiments.

In some embodiments, as shown in FIG. 1, the base 102 includes an aperture 106 through which a lever handle 108 (see FIG. 4) may be passed for mounting the lock 100 to the door. As shown in this view, in such embodiments, the aperture may include an opening that extends through the base. As will be appreciated, although the aperture is shown as being substantially circular in cross section in FIG. 1, the aperture may have other suitable cross-sectional shapes in other embodiments. For example, the aperture may be square, oval, triangular, other polygonal or other suitable shape.

Figure 3:
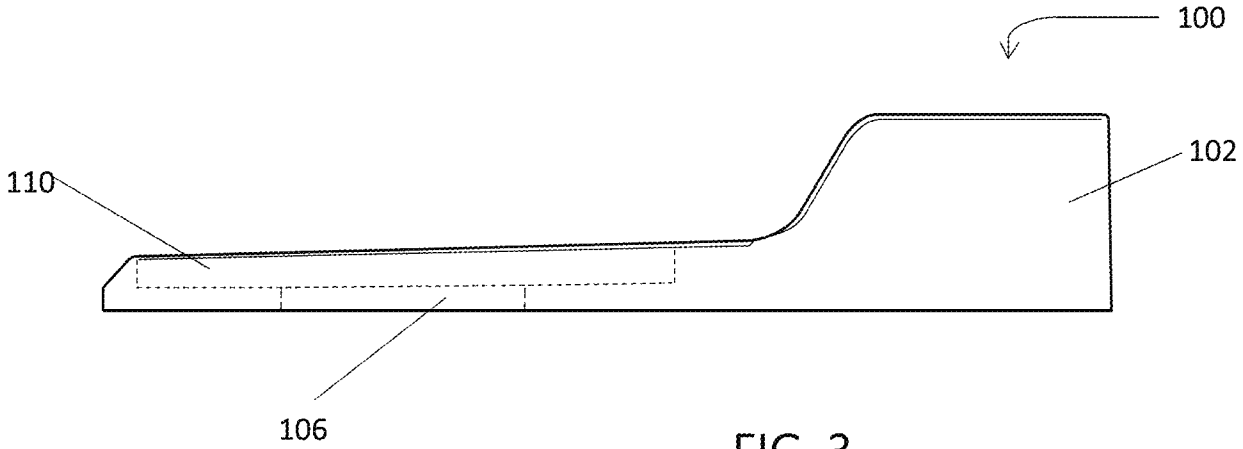
FIG. 3 is a schematic side view of a base of a lever handle lock.

In some embodiments, as shown in FIGS. 1 and 3, the aperture 106 is located in a recess 110 formed in a top portion of the base 102. In some embodiments, the recess 110 may have a substantially circular cross-sectional shape. As shown in FIG. 1, the aperture may be centered in the recess. In some embodiments, the recess 110 is sized to receive a rose 112 of a door lever handle (see FIG. 4). In some embodiments, when the lock 100 is mounted to the door, the base 102 may be sandwiched between a door 114 (see FIG. 4) and the rose 112, with the rose being received in the recess.

Figure 4:
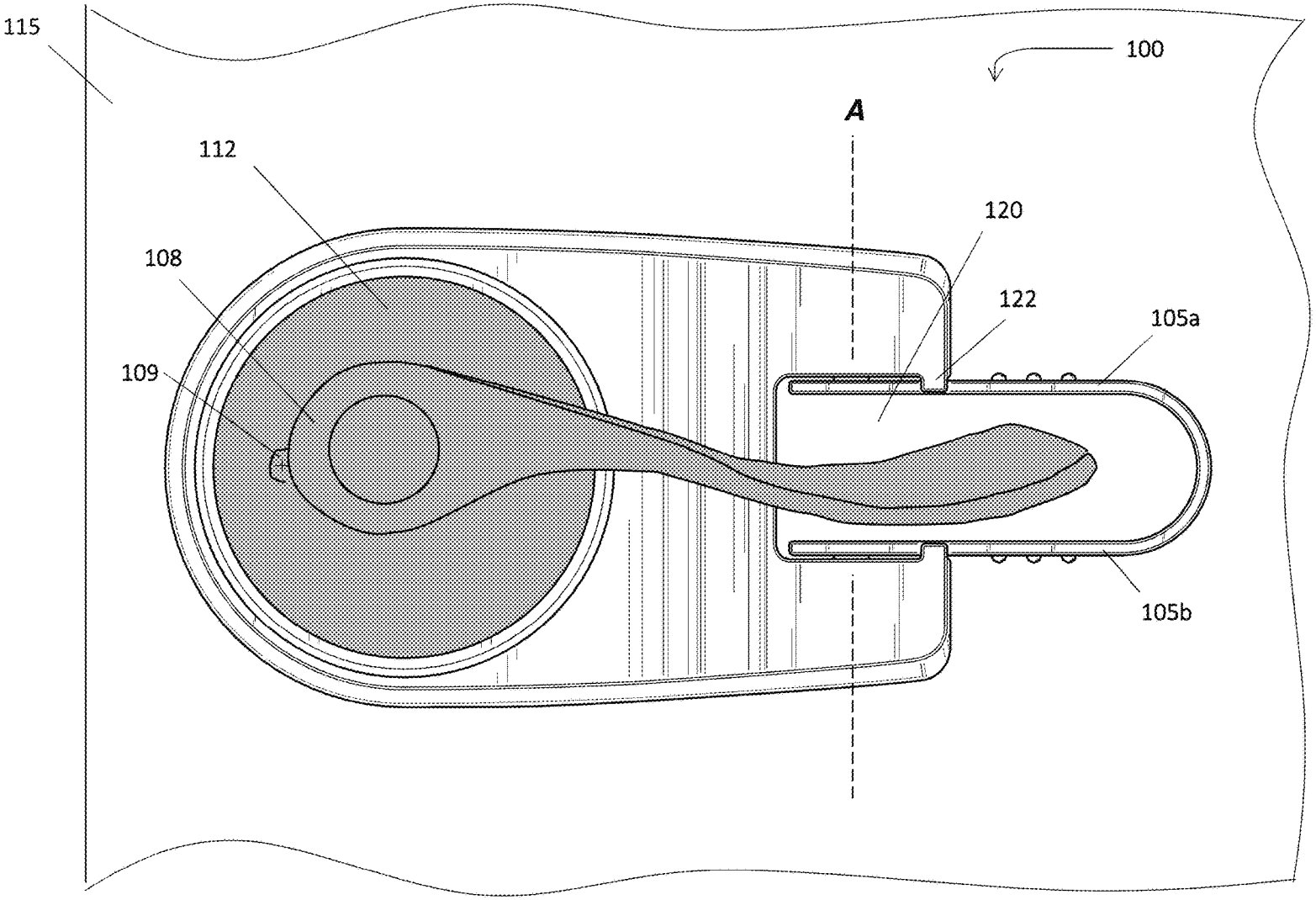
FIG. 4 is a top view of a lever handle lock attached to a door, with a handle guard in a non-locking position.

In some embodiments, as shown in FIG. 1, the base includes one or more channels 110 that extend radially from the aperture. As shown in this view, each of the channels may be formed in the recess 110 of the base and extend through the base. In some embodiments, the one or more channels are used to receive a fastener (e.g., a nail, screw, bolt, etc.) for affixing the base to a door. In some embodiments, as shown in FIG. 4, the fastener 109 may be inserted into the rose 112, through the channels (not shown) in the base, and to the door 114. Although FIG. 1 shows four channels for accepting fasteners, in other embodiments the base may include one or more openings positioned around the aperture for accepting one or more fasteners.

Figure 7:
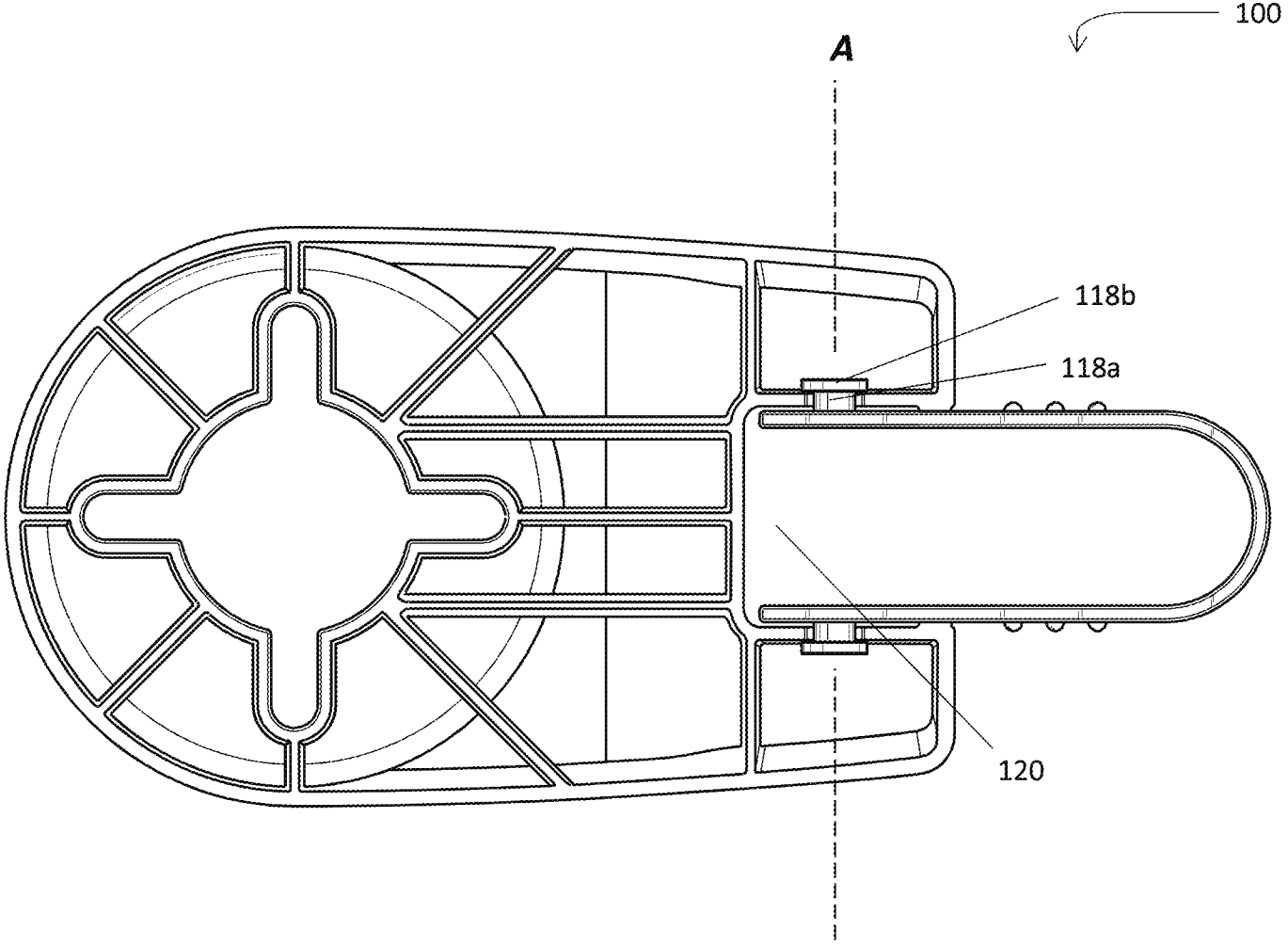
FIG. 7 is a bottom view of the embodiment of FIG. 6.

According to one aspect of the present disclosure, the handle guard is pivotally attached to the base. In some embodiments, as shown in FIG. 2 and FIG. 7, each end of the handle guard may include a rod 114 that is received in a channel 116 formed in the base 102. In some embodiments, as shown in FIG. 7, the rod 114 may include a first portion 118*a* that is sized to fit within and be held by the channel 116. For example, the first portion 118*a* may have a width that is less than a width of the channel. In some embodiments, the rod 114 also includes a second portion 118*b* with a width that is greater than a width of the channel. In some embodiments, by having the second portion of the rod larger than the channel, a connection between the handle guard and the base may be maintained, particularly when the handle guard is being rotated between the locking and non-locking positions.

As will be appreciated, although the handle guard is shown as having rods that engage with corresponding channels on the base, the handle guard may be connected to the base via other suitable arrangements. For example, the base may include one or more rods or other elements that engage with corresponding openings on the handle guard. The handle guard and base also may have corresponding hooks or clips for attaching the handle guard to the base.

As shown in FIGS. 1, 4 and 6-7, the handle guard 104 may be attached at or near a first end of the base, the first end being opposite to the end of the base at or near the aperture for receiving the lever handle. As shown in these views, in some embodiments, the first end includes a recess 120 into which the handle guard 104 is received. In such embodiments, as shown in FIGS. 2 and 7, the channels 116 for receiving the rods 114 are positioned adjacent to the recess 120 for the handle guard 104.

Figure 6:
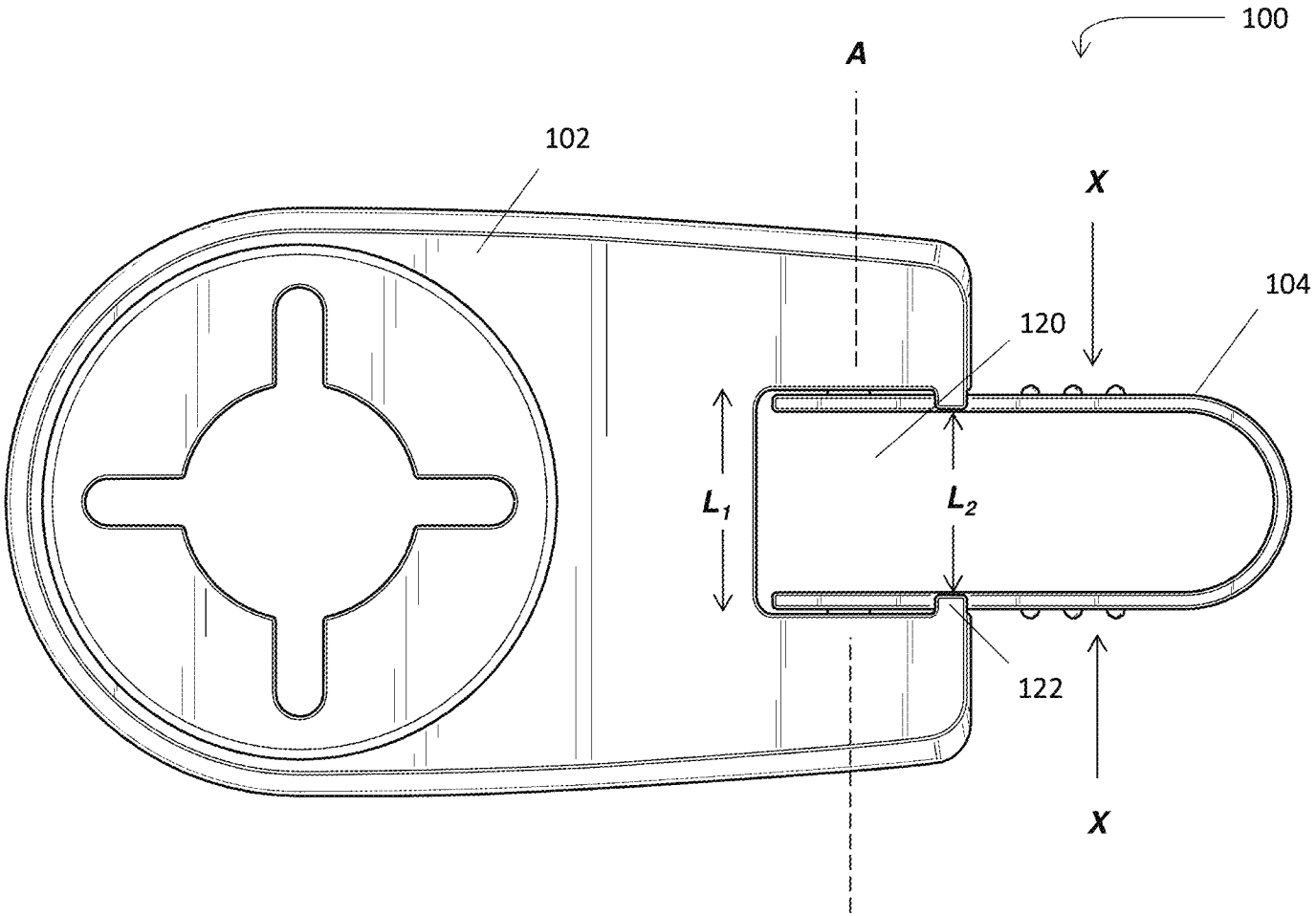
FIG. 6 is a top view of a lever handle lock according to one embodiment, with a handle guard in a non-locking position.

According to an aspect of the present disclosure, the handle guard is arrange to pivot relative to the base between the locking and non-locking positions. As shown in FIGS. 6 and 7, the handle guard may be pivotable about a pivot axis A extending though the rods 114 of the handle guard. In some embodiments, the pivot axis A extends substantially vertical when the lock 100 is mounted to the door. In some embodiments, the pivot axis is substantially perpendicular to a longitudinal axis extending through the handle guard.

Figure 11:
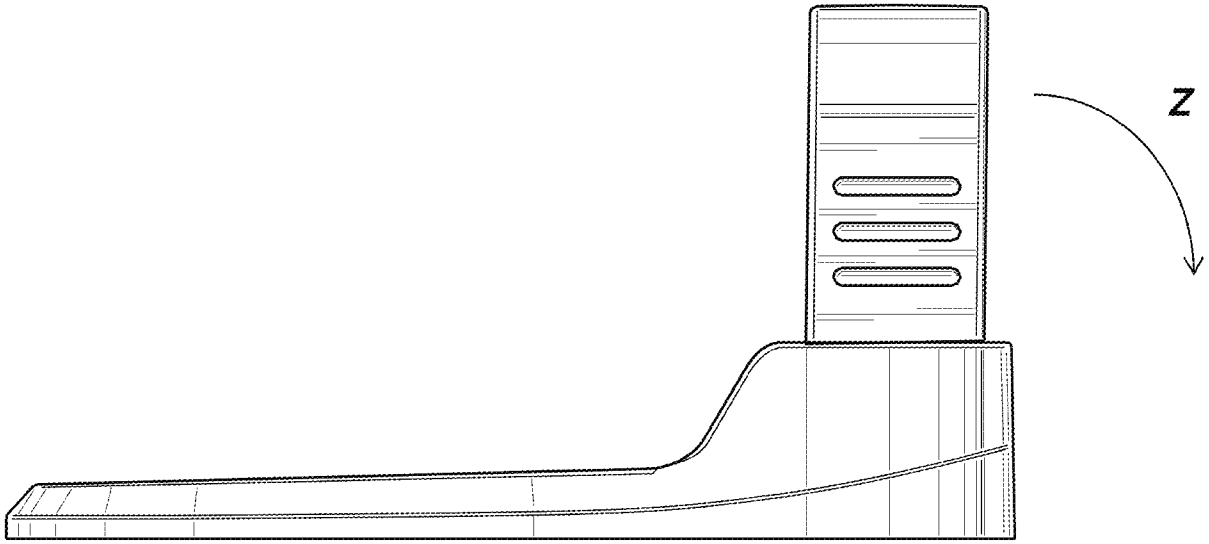
FIG. 11 is a side view of the lever handle lock of FIG. 6, with the handle guard in a locking position.

As shown in FIG. 4, when the handle guard is in the locking position, the handle guard extends over at least a portion of the handle. In some embodiments, the lever handle extends through the handle guard in the locking position. As will be appreciated, in some embodiments, the handle guard may be arranged to extend over only the distal end of the lever handle. In such embodiments, the lever handle may not extend outwardly beyond the handle guard. As shown in FIG. 11, in the locking position, the lever guard 104 extends substantially perpendicular to the base 102 of the lock.

Figure 5:
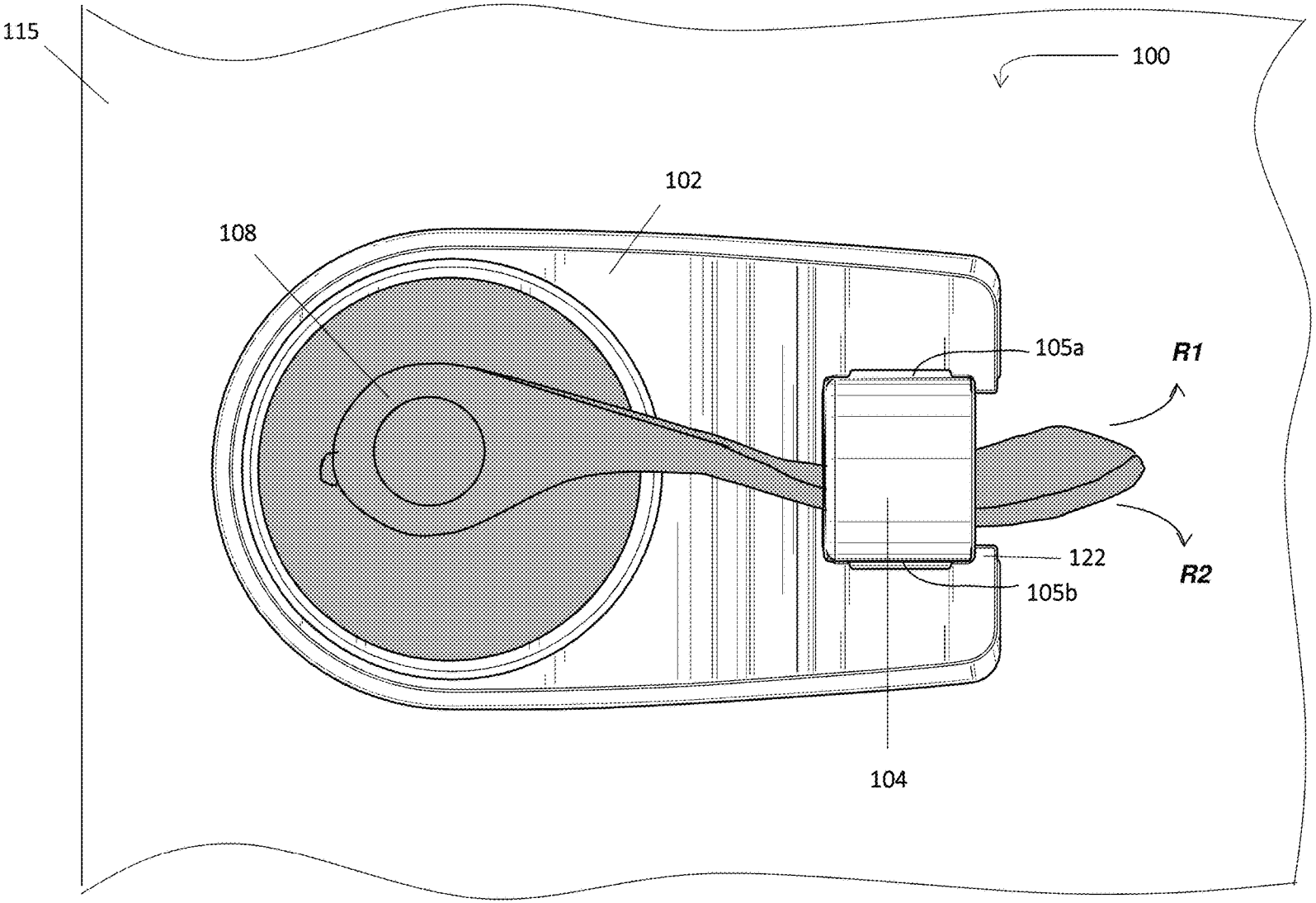
FIG. 5 shows the lever handle and lever handle lock of FIG. 4, with the handle guard in a locking position.

As shown in FIGS. 1-2 and 5, in the locking position, the handle guard is arranged to restrict movement of the lever handle. In some embodiments, as shown in FIGS. 4 and 5, the handle guard includes first and second guard portions 105*a*, 105*b* arranged to restrict rotation of the lever handle. For example, as shown in FIG. 5, if the user tries to rotate the lever handle 108 in a first, upward, direction (see arrow R1) to open the door, the lever handle would contact the first guard portion 105*a* of the lever guard 104 after rotating the handle a few degrees. In a similar manner, if the user tries to rotate the lever handle in a second downward direction (see arrow R2) to open the door, the lever handle would contact the second guard portion 105*b* of the lever guard 104 after rotating the handle a few degrees. In such examples, the handle guard is arranged to permit some rotation of the lever handle, but not enough to allow unlatching of the door. For example, in some embodiments, the lever handle may rotate less than about five degrees in the upward and downward directions R1, R2. In other embodiments, the handle guard may be arranged to prevent almost any rotation of the door lever handle when the handle guard is in the locked position.

As will be appreciated, although the handle guard is shown as being a loop with the first and second guard portions 105*a*, 105*b* attached to one another, in other embodiments, the first and second guard portions may be separate from one another. For example, the handle guard may include two separate guard portions that are pivotable between the locking and non-locking positions.

Figure 10:
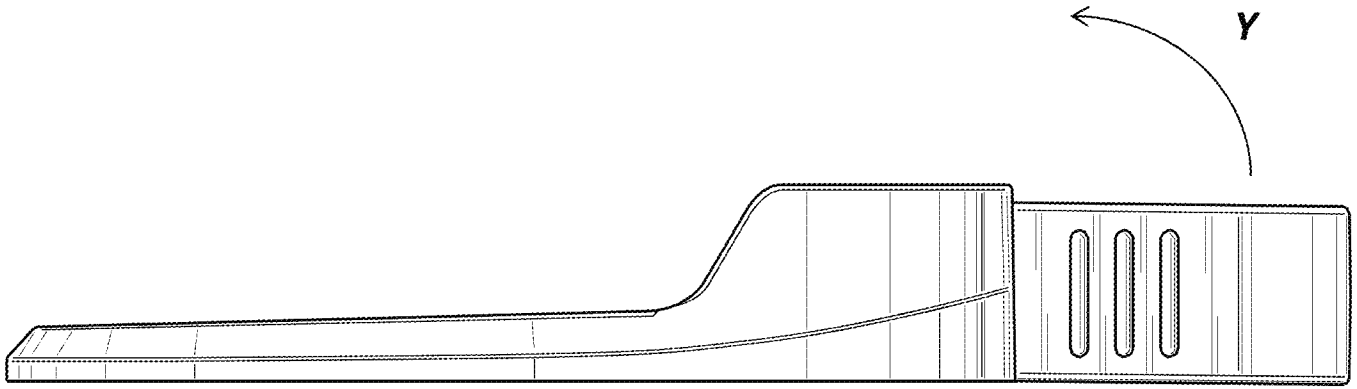
FIG. 10 is a side view of the lever handle lock of FIG. 9.

As shown in FIGS. 4 and 10, when the handle guard is in the non-locking position, the lever handle is permitted to rotate. In some embodiments, when the handle guard is in the non-locking position, the user may first need to push or rotate a lock button on the handle apparatus before being able to rotate the lever handle to open the door. As shown in FIG. 4, in some embodiments, in the non-locking position, the lengths of the handle guard portions 105*a*, 105*b* may be positioned substantially parallel to the base and/or to the lever handle.

In some embodiments, the lever handle lock 100 is arranged to lock the handle guard in each of the locking and non-locking positions. For example, in some embodiments, the recess is arranged to hold the handle guard in the locking and non-locking positions. The user may secure the handle guard in the non-locking position to avoid having the handle guard inadvertently move to the locking position on the opposite side of the door from the user. With doors where the lever handles on both sides of the door operate in tandem, having the lever handle lock move to a locking position would make the door not openable from the opposite side of the door.

In some embodiments, to lock the handle guard in the locking position, the recess 120 has at least one blocker positioned to block movement of the handle guard out of the locking position. The same or additional blockers may be positioned to block movement of the handle guard out of the non-locking position in some embodiments. In some embodiments, the blocker impedes a portion of one of the first and second guard portions. As shown in FIG. 6, in some embodiments, the blockers include one or more protrusions 122 that extend inwardly into the recess. In some embodiments, the one or more protrusions are positioned at a top portion of the recess opening (e.g., at a top of the base) and form a ledge.

Figure 8:
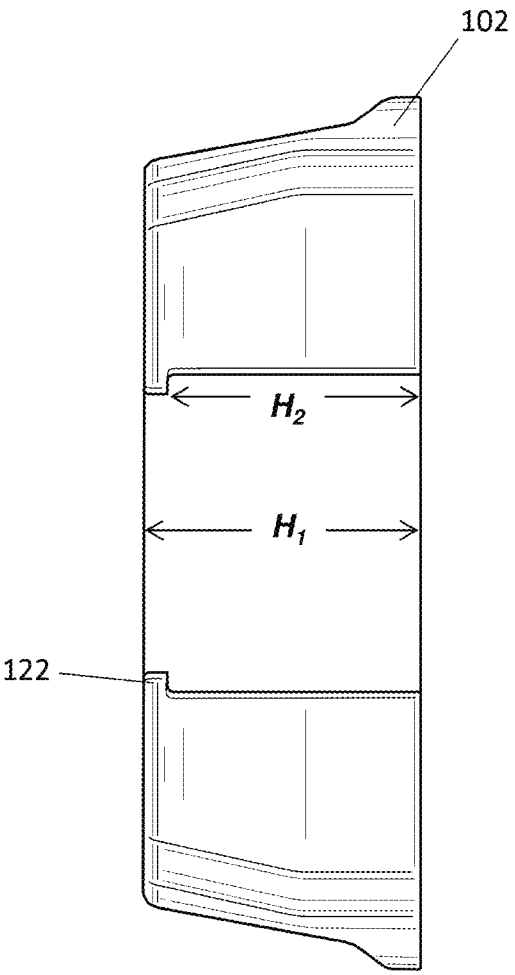
FIG. 8 is a side view of a base of the lever handle lock of FIG. 6.

In some embodiments, the protrusions reduce a length and height of the ends of the recess to block the handle guard from being able to pivot. For example, as shown in FIG. 6 the recess has a first length $L_1$ along a portion of the recess and a second length $L_2$ at an end of the recess 120. The second length $L_2$ is smaller than the first length $L_1$. In a similar manner, as shown in FIG. 8, the recess 120 has a first height $H_1$ along a portion of the recess and a second width $H_2$ at ends of the recess. In such embodiments, the second height $H_2$ is smaller than the first height $H_1$. As will be appreciated, although the lengths and heights of the recess are being restricted at only the ends of the recess, in other embodiments, the protrusions may extend across a greater portion of the recess.

Figure 9:
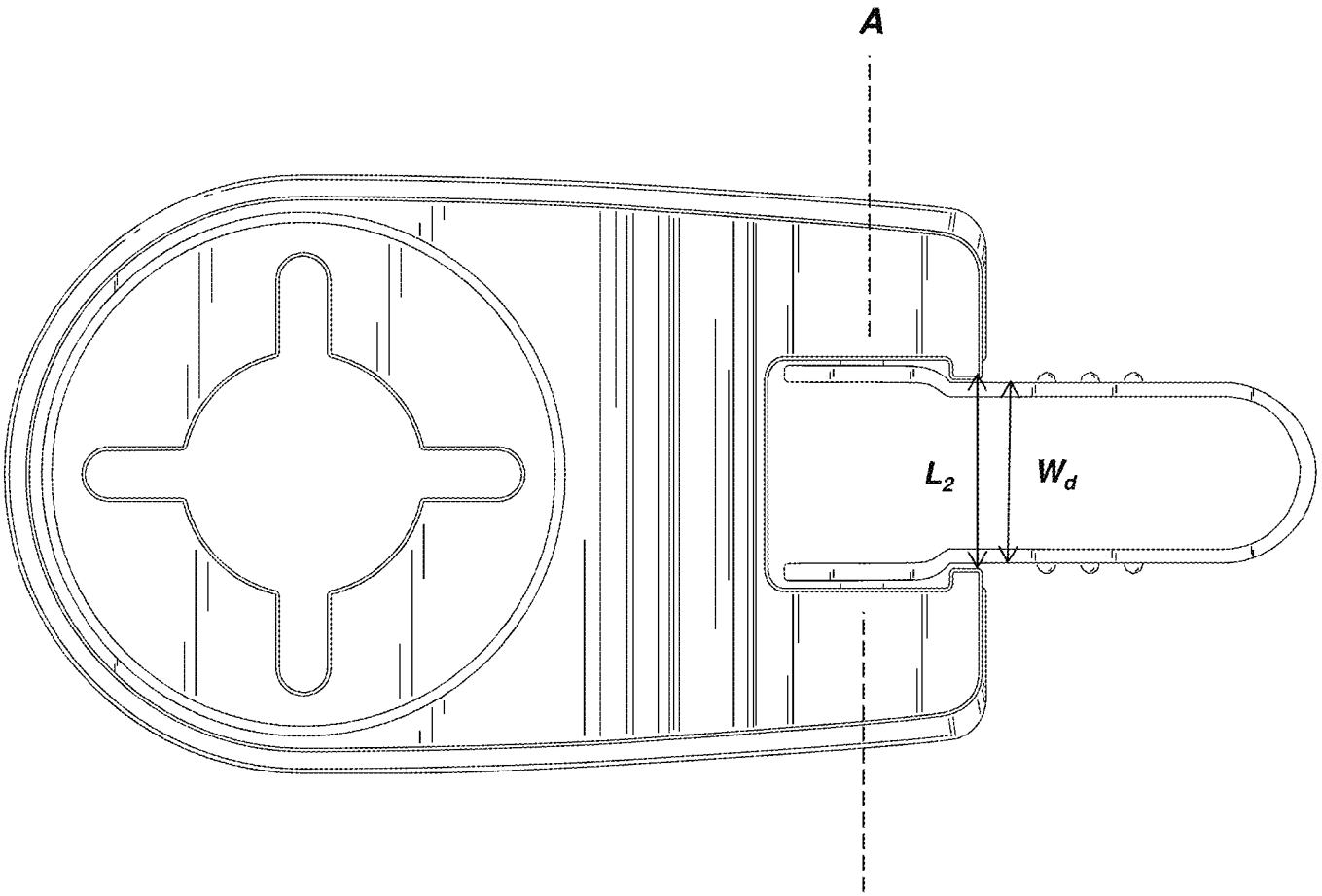
FIG. 9 is a top view of the lever handle lock of FIG. 6, with the handle guard pressed inwardly.

FIGS. 6, 7, 9, and 10 show the handle guard in a non-locking position. FIG. 11 shows the handle guard in the locking position. In some embodiments, as shown in FIG. 6, when the handle guard is in the non-locking position, the handle guard is positioned below the protrusions 122 such that the handle guard does not pivot out of the non-locking position. In such embodiments, to move the handle guard to the locking position, the user may press inwardly (e.g., squeeze) on the both an upper portion and lower portion of the handle guard (see arrows X) to deform at least a portion of the handle guard. In some embodiments, deforming at least a portion of the handle guard includes bending at least a portion of the handle guard. In some embodiments, the first and second guard portions are moveable closer to one another by squeezing the upper and lower portions of the handle guard. As shown in FIG. 9, pressing inwardly on the handle guard may decrease the width of at least a portion of the handle guard such that the handle guard is smaller than and may pass through the area between the two protrusions 122. FIG. 9 illustrates an example of the handle guard after the user has pressed inwardly on the handle guard to decrease a width of at least a portion of the handle guard to a width $W_d$ that is less than the second length $L_2$ of the recess (e.g., at the end of the recess).

Next, as shown in FIG. 10, the handle guard may be rotated upwardly (see arrow Y) until the handle guard has reached the locking position. Once in the locking position, the user may release the handle guard to return the handle guard to its original width, greater than the second length $L_2$ of the recess, and lock the handle guard in position. As shown in FIG. 5, in the locking position, the handle guard is positioned to the left of the protrusions 122 in the recess. In this position, the protrusions 122 block the handle guard from being able pivot toward the non-locking position.

To move the handle guard back to the non-locking position, the user may again press inwardly on the handle guard to decrease the width of at least a portion of the handle guard. Next, as shown in FIG. 11, the wearer may pivot the handle guard away from the lever handle in the direction of arrow Z until the handle guard is positioned in the non-locking position. As with the above, the user may then release the handle guard to allow the handle guard to return to its original width, greater than the second height of the $H_2$ of recess, and lock the handle guard in the non-locking position.

As shown in FIGS. 10-11, the handle guard may be pivoted ninety degrees between the locking and non-locking positions. As will be appreciated, the lever handle lock may be arranged to pivot at other suitable angles. For example, the handle guard may pivot by an amount between 45 degrees and 90 degrees, or may pivot by more than 90 degrees to move the handle guard between the locking and non-locking positions.

As will be appreciated in view of the above, in some embodiments, the handle guard is formed of a material that is sufficiently flexible to be at least partially deformable to reduce the width of the handle guard so that the handle guard may be passed through the protrusions at the end of the recess. The handle guard also may be formed of a material that is sufficiently rigid to maintain the shape of the handle guard such that the handle guard may be locked in each of the locking and unlocking positions. In some embodiments, the handle guard is resilient such that the handle guard returns to its original shape and width when the user releases the handle guard. In some embodiments, the handle guard may be additionally biased toward a secured state (e.g., not squeezed) by an additional element such as a spring or other resilient element.

According to another aspect of the present disclosure, a method of locking and unlocking a lever handle is disclosed. In some embodiments, the method includes pressing or squeezing inwardly on the handle guard and pivoting the handle guard from the non-locking position to the locking position. The method further includes releasing the handle guard and locking the handle guard in the locking position, with the handle guard being positioned to the left of the protrusions in the recess. In the locking position, the handle guard surrounds at least a portion of the lever handle. In some embodiments, the method includes pressing or squeezing inwardly on the handle guard and pivoting the hand guard from the locking position to the non-locking position. Once in the non-locking position, the wearer may release the handle guard to lock the handle guard in the non-locking position. In this position, the handle guard is positioned below the protrusions in the recess and is located outwardly of the lever handle. In this position, the lever handle is unobstructed by the handle guard and may be used normally.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A lock for a door lever handle, the lock comprising:

a base configured to mount the lock to a door having a lever handle;

a lever handle guard pivotally attached to the base, the lever handle guard being pivotable between a locking position and a non-locking position, the lever handle guard comprising:

a first guard portion arranged to prevent rotation of the lever handle beyond a first rotation angle in a first direction when the lever handle guard is in the locking position;

a second guard portion arranged to prevent rotation of the lever handle beyond a second rotation angle in a second direction when the lever handle guard is in the locking position, the second direction being opposite to the first direction; and a first blocker positioned to prevent movement of the lever handle guard from the non-locking position to the locking position;

a second blocker positioned to prevent movement of the lever handle guard from the locking position to the non-locking position;

wherein, when the lever handle guard is secured in the non-locking position, the first and second guard portions are arranged to permit rotation of the lever handle in the first and second rotation directions beyond the first and second rotation angles without any portion of the lever handle contacting the first guard portion when the lever handle is rotated in the first direction and without any portion of the lever handle contacting the second guard portion when the lever handle is rotated in the second direction.

2. The lock of claim 1, wherein first and second guard portions include first and second portions of a loop.

3. The lock of claim 1, wherein the first and second guard portions are connected to one another.

4. A lock for a door lever handle, the lock comprising:

a base configured to mount the lock to a door having a lever handle; and a lever handle guard pivotally attached to the base, the lever handle guard being pivotable between a locking position and a non-locking position, wherein the lever handle guard is securable in the non-locking position, the lever handle guard comprising:

a first guard portion arranged to prevent rotation of the lever handle beyond a first rotation angle in a first direction when the lever handle guard is in the locking position; and a second guard portion arranged to prevent rotation of the lever handle beyond a second rotation angle in a second direction when the lever handle guard is in the locking position, the second direction being opposite to the first direction;

wherein, when the lever handle guard is secured in the non-locking position, the first and second guard portions are arranged to permit rotation of the lever handle in the first and second rotation directions beyond the first and second rotation angles without contacting the first and second guard portions;

wherein the first and second guard portions are connected to one another; and wherein the lever handle guard is constructed and arranged such that movement of the first and second guard portions toward one another allows the lever handle guard to pivot from the locking position to the non-locking position.

5. The lock of claim 4, wherein the first and second guard portions are movable toward and away from one another to allow the lever handle guard to be moved into and out of a recess formed in the base.

6. The lock of claim 1, wherein the lever handle guard is pivotable relative to the base about a pivot axis.

7. The lock of claim 5, wherein, when the lock is mounted to the door, the pivot axis is vertical.

8. The lock of claim 1, wherein the lever handle guard is attached to the base via first and second rods which form the pivot axis.

9. The lock of claim 1, wherein a first end of the base includes a recess arranged to receive at least a portion of the lever handle guard.

10. The lock of claim 9, wherein an end of the recess includes the blocker positioned to prevent movement of the lever handle guard.

11. The lock of claim 8, wherein the one or more rods include one or more protrusions.

12. The lock of claim 11, wherein the one or more protrusions are arranged to block movement of the lever handle guard from the locking position to the non-locking position.

13. The lock of claim 1, wherein the second blocker is positioned on the base.

14. The lock of claim 1, wherein the base is attachable to the door via a door knob cylinder piece.

15. A combination of a lock, a door lever handle, and a latch where the lever handle is rotatable to release the latch from a doorframe, the combination comprising:

a lock comprising:

a base configured to mount the lock to a door having a lever handle and a latch, wherein the lever handle is rotatable to release the latch from a doorframe;

a lever handle guard pivotally attached to the base to rotate around a vertical pivot axis, the lever handle guard being pivotable between a locking position and a non-locking position around the vertical pivot axis;

wherein when the lever handle guard is secured in the non-locking position the handle guard permits sufficient rotation of the lever handle to pull back the latch and release the latch from the doorframe, and wherein when the lever handle guard is secured in the non-locking position, the lever handle guard is not pivotable by a sufficient amount to pull back the latch and release the latch from the doorframe.

16. A lock for a door lever handle, the lock comprising:

a base configured to be mounted to a door;

a lever handle guard attached to the base, the lever handle guard being movable between a locking position and a non-locking position, the lever handle guard including:

a first guard portion arranged to prevent rotation of the lever handle beyond a first rotation angle in a first direction when the lever handle guard is in the locking position;

a second guard portion arranged to prevent rotation of the lever handle beyond a second rotation angle in a second direction when the lever handle guard is in the locking position, the second direction being opposite to the first direction;

wherein:

the lever handle guard is securable in the locking position; and the lever handle guard is constructed and arranged such that movement of the first guard portion closer to the second guard portion unsecures the lever handle guard from the locking position.

17. The lock of claim 16, wherein the lever handle guard is pivotably attached to the base and is pivotable between the locking position and the non-locking position.

18. The lock of claim 17, wherein the first guard portion is attached to the second guard portion, and the first guard portion is movable closer to the second guard portion by pressing on the first guard portion and bending at least a portion of the lever handle guard.

19. The lock of claim 18, wherein the lock is adapted to permit the first and second guard portions to move toward each other when each of the first and second guard portions are pressed toward each other.

20. The lock of claim 19, wherein, when secured in the locking position, the lever handle guard portion is blocked from pivoting relative to the base by a blocker impeding a portion of the first guard portion.

21. The lock of claim 20, wherein the first guard portion is movable closer to the second guard portion by a sufficient distance to move the portion of the first guard portion away from the blocker such that the lever handle guard is pivotable to the locking position.

22. The lock of claim 16, wherein the base includes an opening positioned to receive door handle components when the lock is mounted to a door with the lever handle guard positioned close to the door lever handle.

23. The lock of claim 12, wherein the one or more protrusions are arranged to block movement of the lever handle guard from the non-locking position to the locking position.

24. The lock of claim 1, wherein the base includes an opening positioned to receive door handle components when the lock is mounted to a door.

25. The lock of claim 1, wherein the base is adapted to be fixedly attached to the door, separate from the door handle.

26. The lock of claim 4, wherein the base includes an opening positioned to receive door handle components when the lock is mounted to a door.

27. The lock of claim 4, wherein the base is adapted to be fixedly attached to the door, separate from the door handle.

28. The lock of claim 15, wherein the base includes an opening positioned to receive door handle components when the lock is mounted to a door.

29. The lock of claim 15, wherein the base is adapted to be fixedly attached to the door, separate from the door handle.

30. The lock of claim 16, wherein the base is adapted to be fixedly attached to the door, separate from the door handle.

31. A lock for a door lever handle, the lock comprising:

a base configured to mount the lock to a door having a lever handle which rotates a spindle;

a lever handle guard pivotally attached to the base, the lever handle guard being pivotable between a locking position and a non-locking position, wherein the lever handle guard is configured to be secured in the locking position, and the lever handle guard extends substantially perpendicular to the base when the lever handle guard is secured in the locking position, the lever handle guard comprising:

a first guard portion arranged to prevent rotation of the lever handle beyond a first rotation angle in a first direction when the lever handle guard is in the locking position;

a second guard portion arranged to prevent rotation of the lever handle beyond a second rotation angle in a second direction when the lever handle guard is in the locking position, the second direction being opposite to the first direction; and a blocker positioned to prevent movement of the lever handle guard from the non-locking position to the locking position;

wherein the first guard portion pivots about a pivot axis to move from the non-locking position to the locking position, and the pivot axis and the first guard portion are arranged such that when the lock is mounted to a door having a door lever handle which rotates a spindle, the pivot axis and the first guard portion are positioned on a same side of the spindle;

wherein, when the lever handle guard is in the non-locking position, the first guard portion is arranged to permit rotation of the lever handle in the first rotation direction beyond the first rotation angle without the lever handle contacting the first guard portion, and the second guard portion is arranged to permit rotation of the lever handle in the second rotation direction beyond the second rotation angle without the lever handle contacting the second guard portion.

32. A lock for a door lever handle, the lock comprising:

a base configured to mount the lock to a door having a lever handle;

a lever handle guard pivotally attached to the base, the lever handle guard being pivotable between a locking position and a non-locking position, the lever handle guard comprising:

a first guard portion arranged to prevent rotation of the lever handle beyond a first rotation angle in a first direction when the lever handle guard is in the locking position;

a second guard portion arranged to prevent rotation of the lever handle beyond a second rotation angle in a second direction when the lever handle guard is in the locking position, the second direction being opposite to the first direction; and a first blocker positioned to prevent movement of the lever handle guard from the non-locking position to the locking position, wherein the first blocker is positioned to prevent movement of the lever handle guard from the locking position to the non-locking position;

wherein, when the lever handle guard is secured in the non-locking position, the first and second guard portions are arranged to permit rotation of the lever handle in the first and second rotation directions beyond the first and second rotation angles without any portion of the lever handle contacting the first guard portion when the lever handle is rotated in the first direction and without any portion of the lever handle contacting the second guard portion when the lever handle is rotated in the second direction.

33. The lock of claim 32, wherein the first blocker is a protrusion.

34. The lock of claim 32, further comprising a second blocker positioned to prevent movement of the lever handle guard from the locking position to the non-locking position.

35. The lock of claim 32, wherein the first guard portion is connected to the second guard portion.

36. The lock of claim 32, wherein the lever handle guard is constructed and arranged such that movement of the first and second guard portions toward one another allows the lever handle guard to pivot from the locking position to the non-locking position.

* * * * *